US006053701A

United States Patent [19]

Ichiryu et al.

[11] Patent Number: 6,053,701

[45] Date of Patent: Apr. 25, 2000

[54] GAS TURBINE ROTOR FOR STEAM COOLING

[75] Inventors: Taku Ichiryu; Yasuoki Tomita, both of Hyogo-ken, Japan

[73] Assignee: Mitsubishi Heavy Industries, Ltd., Tokyo, Japan

[21] Appl. No.: 09/125,882

[22] PCT Filed: Jan. 22, 1997

[86] PCT No.: PCT/JP98/00243

§ 371 Date: Sep. 27, 1998

§ 102(e) Date: Aug. 27, 1998

[87] PCT Pub. No.: WO98/32953

PCT Pub. Date: Jul. 30, 1998

[30] Foreign Application Priority Data

Jan. 23, 1997 [JP] Japan ..... 9-010434

[51] Int. Cl.[7] ..... F04D 29/58

[52] U.S. Cl. ..... 416/96 R; 415/115

[58] Field of Search ..... 415/114, 115, 415/116; 416/95, 96 A, 96 R, 97 R

[56] References Cited

U.S. PATENT DOCUMENTS 5,695,319 12/1997 Matsumoto et al. ..... 416/95

FOREIGN PATENT DOCUMENTS

| | | |
|---|---|---|
| 19-167029 | 9/1944 | Japan . |
| 46-17721 | 5/1971 | Japan . |
| 7-189739 | 7/1995 | Japan . |
| 8-277725 | 10/1996 | Japan . |
| 1194663 | 6/1970 | United Kingdom . |

*Primary Examiner*—Edward K. Look
*Assistant Examiner*—Rhonda Barton
*Attorney, Agent, or Firm*—Sughrue, Mion, Zinn, Macpeak & Seas, PLLC

[57] ABSTRACT

A cooling steam circulation passage for a gas turbine rotor (30) having turbine discs (41~47) are composed of center line bores (73~77) open at an axial end of the rotor and extending through a central portion of the rotor; a steam inlet-outlet pipe (79) coaxially disposed therein so as to define an annular passage (81) for cooling steam at an outer side; steam cavities (89*a*, 89*b*) defined between and by facing side surfaces of said turbine discs; steam cavities (91*a*, 91*b*) each defined at non-facing side surface portions of said turbine discs (41, 43); axial steam holes (61, 63) formed to extend through the turbine discs and including a partition tube (99); and radial steam holes (97, 103*a*, 103*b*, 105, 107) extending from each of the steam cavities (91*a*, 101, 89*a*) to mounting portions for the rotor blades.

4 Claims, 5 Drawing Sheets

GAS TURBINE ROTOR FOR STEAM COOLING

FIELD OF THE TECHNOLOGY

This invention relates to a gas turbine, and in particular, to a structure of a rotor for cooling rotor blades with steam.

BACKGROUND OF THE TECHNOLOGY

A typical cooling system of a conventional gas turbine is schematically shown in FIG. 4. The gas turbine includes an air compressor 1, a combustion section 3 and a turbine section as main components. Intermediate stage bleeds 7*a*, 7*b*, 7*c* from the air compressor 1 and partial compressor outlet air 9 are led to stationary blades of the turbine 5 so as to cool them. In addition, a portion of the outlet air of the air compressor 1 is led to blade roots 13 of rotor blades of the turbine 5 as a combustor casing bleed, thereby cooling the rotor blades 15. In FIG. 5, a conventional structure for cooling the rotor blades 15 is illustrated. In FIG. 5, a turbine rotor has turbine discs 17*a*, 17*b*, 17*c*, 17*d* which are arranged in line along the rotor axis in mesh engagement between coupling teeth on facing surfaces thereof and through which spindle bolts 19 extend, and the rotating blades 15*a*, 15*b*, 15*c*, 15*d* are mounted on outer peripheries of the turbine discs 17*a*, 17*b*, 17*c*, 17*d*. The combustor casing bleed 11 for cooling, which flows in through an opening 21 in the turbine rotor, flows in an axial direction through axial bores 23*a*~23*c* in the turbine discs 17*a*~17*c* and reaches blade root portions 13*a*~13*d* through radial bores. The bleed or compressed air which flows into internal cooling holes in the rotating blades 15*a*–15*d* through the blade root portions 13*a*–13*d*, cools the rotor blades 15*a*–15*d* from within and finally blows out into the main flow of combustion gas.

Though the technology of cooling a turbine section with such aforementioned bleed air from the compressor has provided adequate effects, there is no end to the need for increasing the output of the gas turbine and improving the efficiency thereof, and it has therefore been proposed to increase the inlet temperature for combustion gas of the gas turbine in order to meet such needs. In this proposal, it is extremely difficult to keep the temperature of the turbine rotor blades below an acceptable value by cooling them with conventional compressed air and hence it has been proposed to use steam as a cooling medium. However, it is not permissible to emit steam into a working gas as with the compressed air in the conventional art.

Accordingly, an object of the present invention is to provide a gas turbine rotor for steam cooling which has a structure suitable for cooling turbine rotor blades with steam.

DISCLOSURE OF THE INVENTION

For the purpose of solving the aforementioned problem, according to the present invention, in a gas turbine rotor composed of at least two turbine discs disposed adjacent to one another along a longitudinal axis and fastened together with spindle bolts extending therethrough, a steam circulating flow passage for cooling rotor blades comprises a center line bore extending at the center of the rotor and open at an axial end of the rotor, a steam inlet-outlet pipe coaxially disposed in the center line bore so as to define an annular passage for a cooling steam between an inner peripheral surface of the bore and the pipe, a first steam cavity defined between facing side surfaces of the turbine discs and communicated with said steam inlet-outlet pipe, second and third steam cavities each defined on an opposite side face of the turbine disc and communicated with the annular passage, an axial steam hole axially extending through the turbine disc spaced apart from the center axis of the disc and including a partition pipe extending through the first steam cavity so as to communicate with the second and third steam cavities, and radial steam holes extending from each of the first, second and third steam cavities towards mounting portions of the rotor blades. Though it is preferable that the annular passage is formed as a supply passage for cooling steam and the interior of the steam inlet-outlet pipe is formed as a return passage for the cooling steam, it is also permissible to form the annular passage as the return passage for cooling steam and the interior of the steam inlet-outlet pipe as the supply passage for the cooling steam.

Furthermore, though the axial steam hole may be independently formed in the turbine disc, a through hole for a spindle bolt extending through the turbine discs so as to integrally combine them may also be used as the axial steam hole.

BEST MODE FOR CARRYING OUT THE INVENTION

Figure 1:
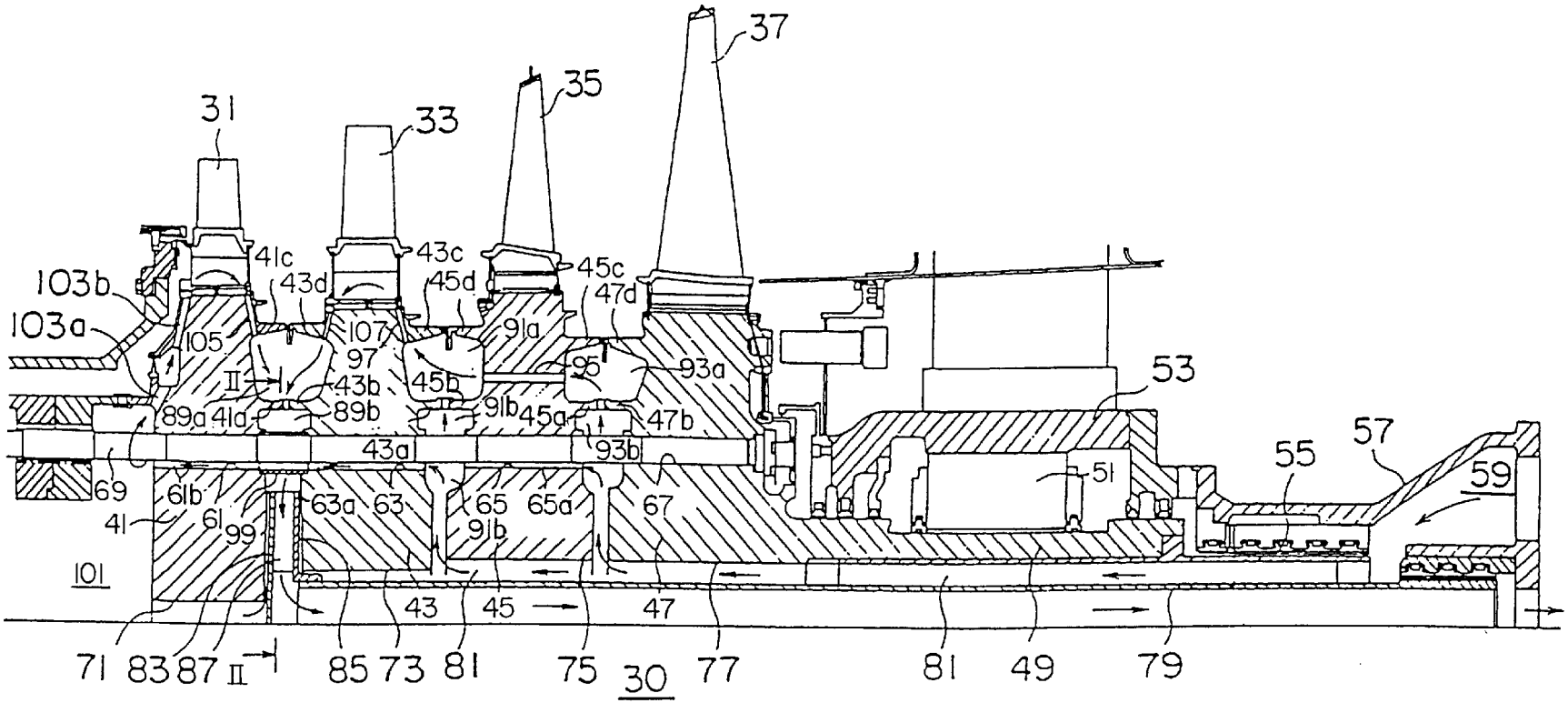
FIG. 1 is a vertical sectional view showing an embodiment of the present invention.
Figure 2:
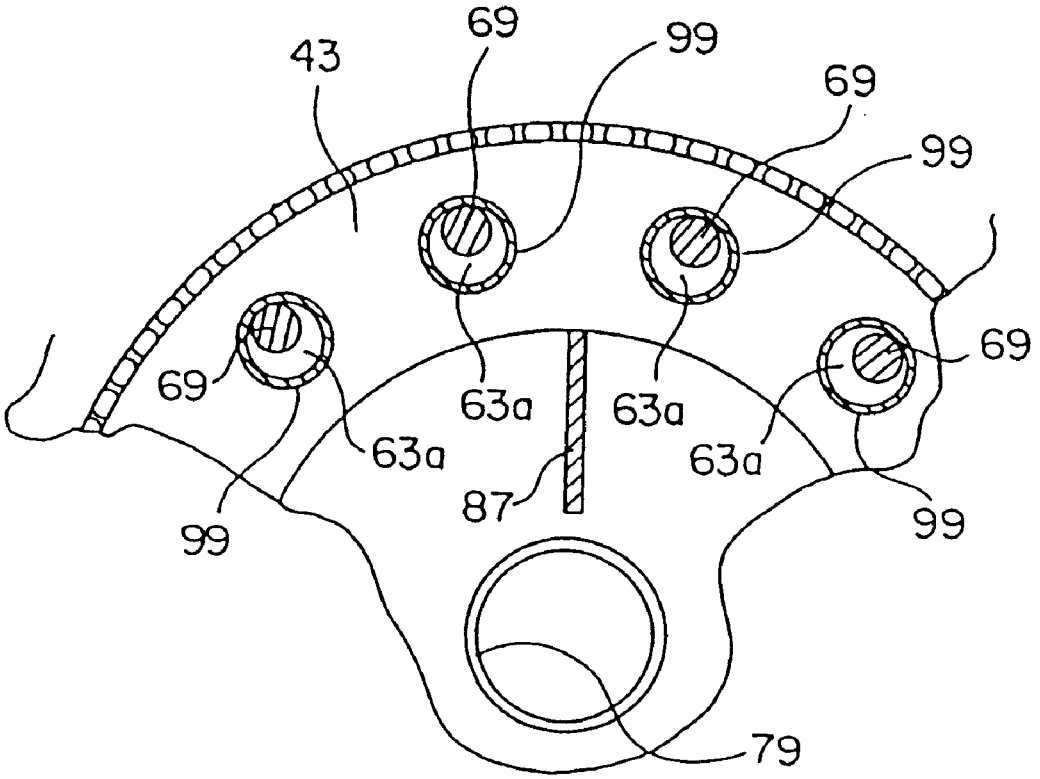
FIG. 2 is a fragmentary cross sectional view taken along line II—II in FIG. 1.

An embodiment according to the present invention will be described hereinafter with reference to the attached drawings. Referring to FIGS. 1 and 2, a turbine rotor 30 is connected, at its left (expressed in the drawings hereinafter in a like manner) end, not depicted here, to a rotor shaft of a compressor, and comprises turbine discs 41, 43, 45, 47 which are integrally combined in an axial line and on which a plurality of first stage rotating blades 31, second stage rotating blades 33, third stages rotating blades 35, and fourth stage rotating blades 37 are separately mounted in a circumferential row. The turbine disc 47 includes an integrally formed support shaft extension 49 which, in turn, is rotatably supported by a casing 53 through a bearing 51. The support shaft extension 49 is further connected, at the right end thereof, to a seal sleeve 55 which is surrounded by a seal housing 57 to thereby define an inlet plenum 59 for cooling steam. The turbine discs 41,43,45 each have engagement protrusions 41*a*, 43*a*, 45*a* at the right side surface thereof provided with coupling teeth at the outermost end, while the turbine discs 43,45,47 each have engagement protrusions 43*b*, 45*b*, 47*b* at their left side surface provided with coupling teeth at the outermost end such that these engagement protrusions 41*a*, 43*a*, 45*a*, and 43*b*, 45*b*, 47*b* engage one another to prevent relative displacement in a circumferential direction. Moreover, spindle bolts 69 are placed through a plurality of axial bores 61, 63, 65, 67 drilled through the turbine discs 41, 43, 45, 47 so as to fasten them. The arrangement relationship between the axial bores 63 and the spindle bolts 69 is made clear in FIG. 2, and that of the other bores 61, 65, 67 is similar to that in the bores 63.

Next, the structure of a circulating passage for the cooling steam will be described. Centerline bores 71,73, 75, 77 extending in the axial direction are formed in central portions of each of the turbine discs 41, 43, 45, 47. As is apparent in the drawings, the diameter of the center line bore 71 is the smallest, that of the center line bore 73 is larger, and those of the center line bores 75, 77 are approximately equal and are the largest. In the center line bores 73, 75, 77 of the turbine discs 43, 45, 47, a steam inlet-outlet pipe 79 extending from the seal housing 57 position is placed and is coaxially disposed so as to define an annular passage 81 communicating with the inlet plenum 59 outside of the pipe. Furthermore, the center line bore 71 in the turbine disc 41 is covered by a disc-shaped cover 83 so as to leave a gap (shown enlargedly) between the right side surface of the disc 41 and the cover 83; in a similar manner, an annular cover 85 leaving a gap (shown enlarged) between the left side surface of the turbine disc 43 and itself, supports the inlet-outlet pipe 79 at the left end thereof. These covers 83, 85 are connected with a connecting plate 87 extending in a radial direction (in particular, refer to FIG. 2).

Moreover, on each of the facing side surfaces of the turbine discs 41, 43, sealing rings 41*c*, 43*d* are protrusively formed near an outer circumferential end thereof so as to define a steam cavity 89*a* communicated with an internal steam cavity 89*b* at an inner side of the engaging protrusions 41*a*, 43*b*. On engaging portions of the coupling teeth, radial gaps extending in a generally radial direction are defined, and depending on the case, a communicating hole may be especially provided through the engagement protrusion 41*a* and/or the engagement protrusion 43*b*. In a similar manner, steam cavities 91*a*, 91*b*, 93*a*, 93*b* are each defined between the turbine discs 43 and 45 and the turbine discs 45 and 47, respectively. The steam cavities 91*b*, 93*a* each communicate with the annular passage 81 while the steam cavities 91*a*, 93*b* communicate with each other through an axial passage 95 in the turbine disc 45, and further the steam cavity 91*a* communicates with a steam port at the root of the rotor blade 33 through the radial passage 97 in the turbine disc 43.

Moreover, since the axial bores 61, 63, 65, as described before, each have an internal diameter larger than the outer diameter of the spindle bolt 69, axial passages 61*a*, 63*a*, 65*a* for steam are defined, and the axial passages 61*a*, 63*a* are connected to each other through a partition tube 99 extending through the steam cavity 89*b*. The axial passage 61*a* is connected to a steam port at the root of the rotor blade 31 through the steam cavity 101 on a left side of the turbine disc 41 and radial passages 103*a*, 103*b* in the turbine disc 41.

On the other hand, the steam cavity 89*a* is communicated to steam ports at the roots of the rotor blades 31, 33 through the radial passage 105 in the turbine disc 41 and the radial passage 107 in the turbine disc 43, respectively.

With such a structure, cooling steam flows, as shown by the arrows, in the annular passage 81 from the inlet plenum 59 into the steam cavities 91*b*, 93*b*. Steam having flowed into the steam cavity 93*b* is divided into two streams; and one stream enters the steam cavity 91*b* through the axial passage 65*a* while the other enters the steam cavity 91*a* through the steam cavity 93*a* and the axial passage 95. Steam in the steam cavity 91*b* also flows in two separate directions, as shown by the arrows. One stream enters the steam cavity 91*a* and meets a steam flowing from the steam cavity 93*a*. This combined steam flows into a root portion of the rotor blades 33 through the radial passage 97, and then flows into a cooling passage (not shown) in the rotor blade 33 thereby steam cooling the rotor blade 33. The steam, having finished the cooling function and with an increased temperature, then enters the steam cavity 89*a* through the radial passage 107. The other stream flows successively through the axial passage 63*a*, the partition pipe 99 and the radial passage 61*a* into the steam cavity 101, and further flows through the radial passages 103*a*, 103*b* and reaches the root portion of the rotor blade 31. Then, the steam flows through a cooling passage (not shown) in the rotor blade 31 thereby steam cooling the rotor blade 31. The steam, having finished a cooling function and with an increased temperature, enters the steam cavity 89*a* through the radial passage 105.

The steam having thus finished cooling the blades 31, 33 and returned to the steam cavity 89*a*, flows through the steam cavity 89*b*, between the covers 83, 85 and finally through the interior of the steam inlet-outlet pipe 79 and out of the turbine. As can be seen from the above description, the steam cavities 89*a*, 89*b*, the steam inlet-outlet pipe 79, etc. function as a cooling steam discharge channel in the present embodiment. In addition, a small amount of the cooling steam also flows in the center line bores 71, 73 and through gaps on the other side of the covers 83, 85, thereby protecting the turbine discs 41, 43 from the high temperature of the discharging steam.

Figure 3:
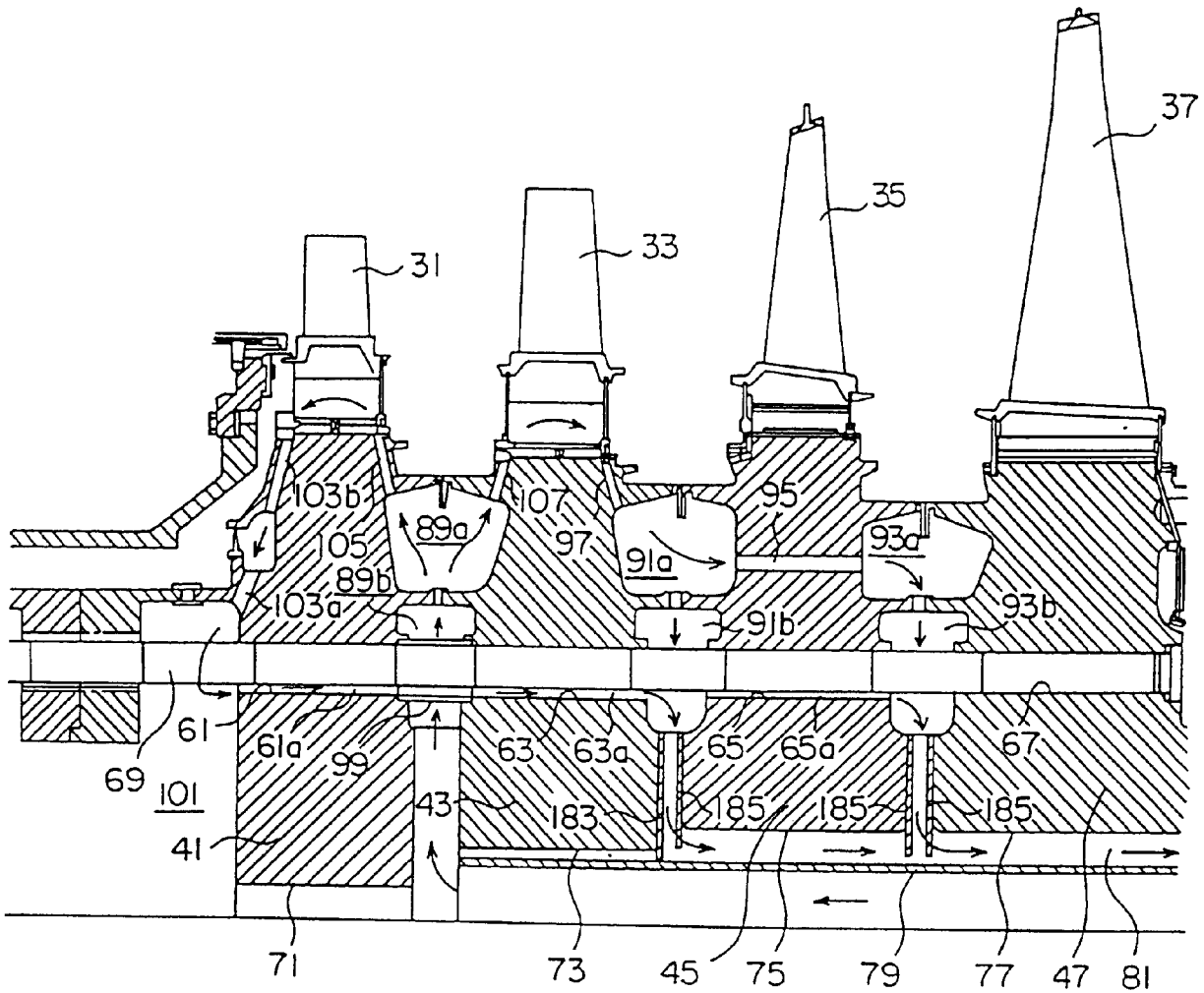
FIG. 3 is a fragmentary sectional view showing a modified embodiment with a portion of the aforementioned embodiment changed.
Figure 4:
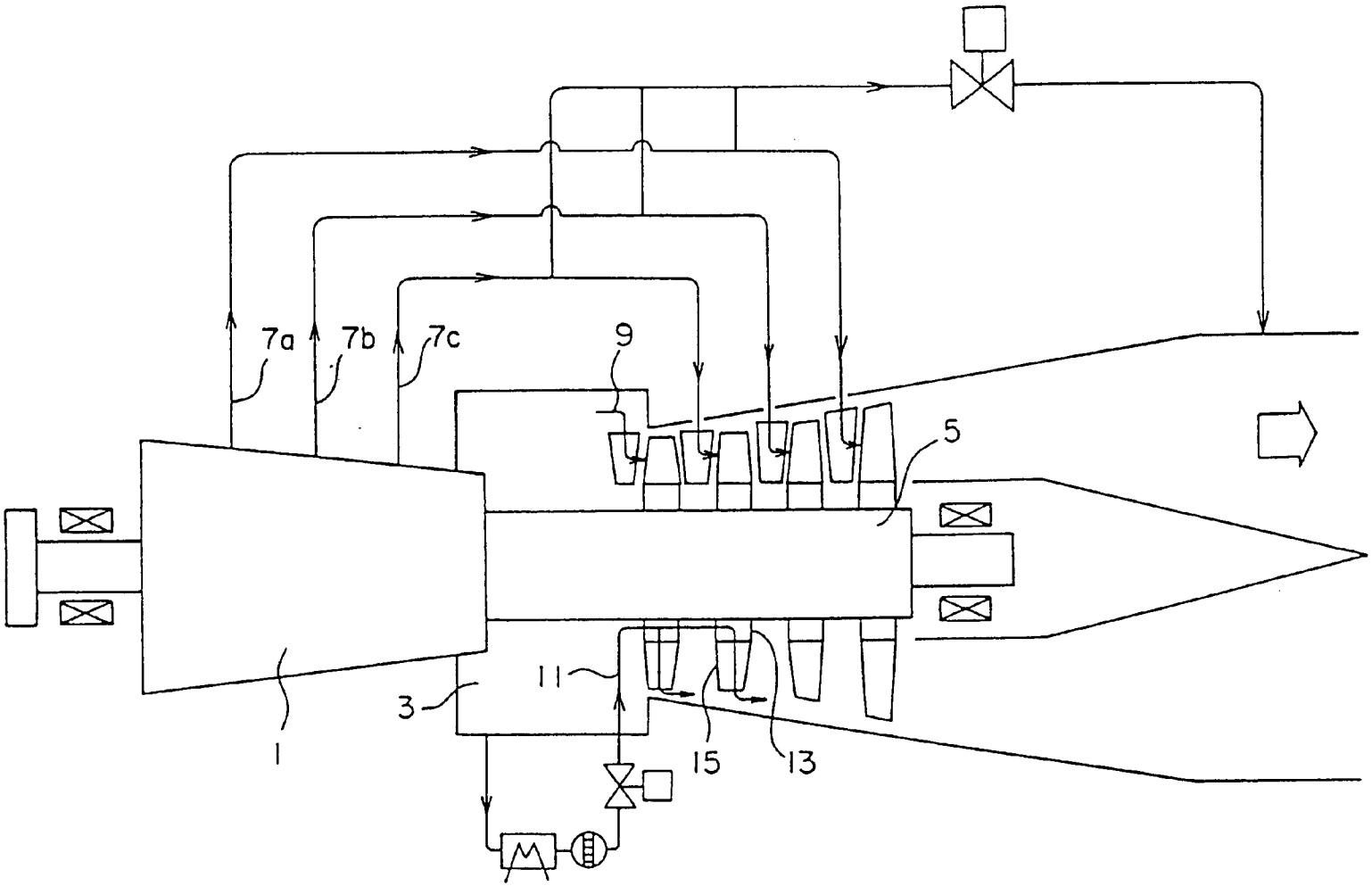
Fig. 4 PRIOR ART
FIG. 4 is a schematic cooling system for a conventional gas turbine.
Figure 5:
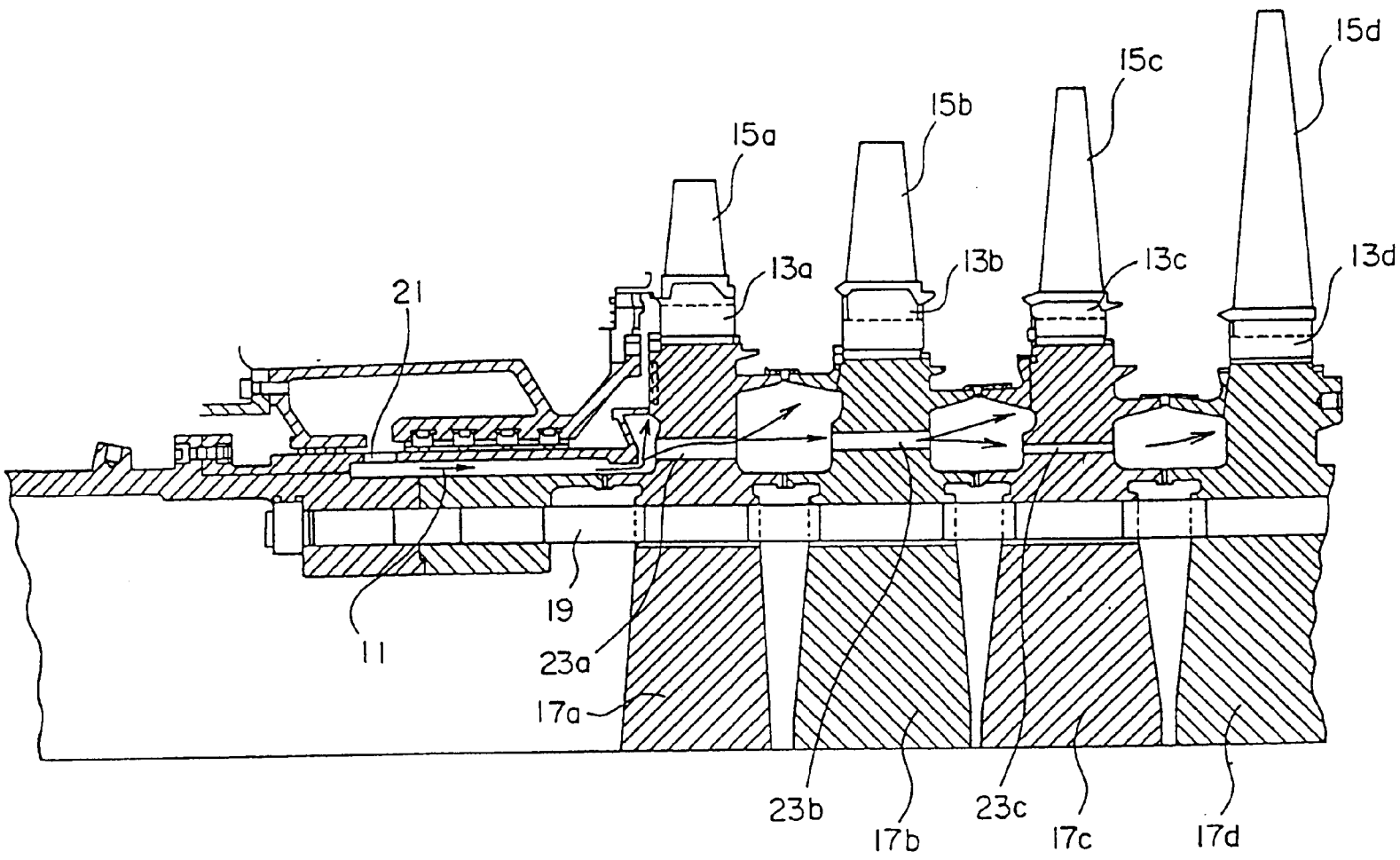
Fig. 5 PRIOR ART
FIG. 5 is a fragmentary longitudinal sectional view of a conventional gas turbine.

Although in the embodiment described above the annular passage 81 is used as a supply pipe for cooling steam and the interior of the steam inlet-outlet pipe 79 as a discharge pipe for the cooling steam, one option is to design the flow of the steam in the reverse direction as shown in FIG. 3. In such a case, the interior of the steam inlet-outlet pipe 79 and the steam cavities 89*a*, 89*b*, etc., communicated thereto become the supply channel for the cooling steam while the annular passage 81 and the steam cavities 91*a*, 91*b*, 93*a*, 93*b*, 101, etc., communicated thereto become the discharge channel. In FIG. 3, portions or members that are the same as in FIG. 1 are designated with the same reference numerals, and a cover 183 is disposed on a right side face of the turbine disc 43, and covers 185 are disposed on opposite side faces of the turbine disc 45 and a left side face of the turbine disc 47. The covers 183, 185 are fixed in a state similar to that of the covers 83, 85 described before. Further, those skilled in the art are able to readily understand the construction, functions and advantages of this modified embodiment without specific descriptions in view of the before mentioned description, because the functions are not changed except that the flow direction of the cooling steam is opposite that of the above mentioned embodiment in FIG. 1.

APPLICABILITY IN INDUSTRY

As described above, according to the present invention, two passages are coaxially defined by disposing a steam inlet-outlet pipe in center line bores of the turbine discs, thereby defining a supply and discharge channel for steam. Moreover, since a space defined between adjacent turbine discs is divided into a supply and discharge passage for the steam, the discharge passage for the cooling steam is secured thereby sufficiently cooling a gas turbine. Thus, increased inlet gas temperatures can be permitted resulting in a gas turbine with improved efficiency.

What is claimed is:

1. A gas turbine rotor comprising:

at least two turbine discs disposed in an axial row;

a spindle bolt extending through said turbine discs; and a cooling steam circulation passage including (1) a center line bore opening at an axial end of the rotor and extending through a central portion of the rotor;

(2) a steam inlet-outlet pipe coaxially disposed in said center line bore so as to define an annular passage for cooling steam between an inner circumferential surface of said center line bore and said steam inlet-outlet pipe;

(3) a first steam cavity defined by facing side surfaces of said turbine discs and communicated with said steam inlet-outlet pipe;

(4) a second steam cavity and a third steam cavity, each defined by non-facing side surfaces of said turbine discs and communicated with said annular passage;

(5) an axial steam hole extended through said turbine discs, spaced apart from a center line of said turbine discs, and including a partition tube extending through said first steam cavity thereby communicating said second and said third steam cavities; and (6) radial steam holes extending from each of said first, said second, and said third steam cavities to mounting portions for rotor blades;

wherein said centerline bore and said steam inlet-outlet pipe extend through at least one of said turbine discs.

2. The gas turbine rotor according to claim 1, wherein said annular passage is a supply passage for the cooling steam and an interior of said steam inlet-outlet pipe is a discharge passage for the cooling steam.

3. The gas turbine rotor according to claim 1, wherein said annular passage is a discharge passage for the cooling steam and an interior of said steam inlet-outlet pipe is a supply passage for the cooling steam.

4. The gas turbine rotor according to claim 1, wherein said axial steam hole receives said spindle bolt.

* * * * *